US005471729A

United States Patent [19]

Zoltaszek

[11] Patent Number: 5,471,729

[45] Date of Patent: Dec. 5, 1995

[54] RIVETING APPARATUS

[76] Inventor: Zenon Zoltaszek, 57 Rose Street, Liverpool, New South Wales 2170, Australia

[21] Appl. No.: 185,982

[22] PCT Filed: Jul. 15, 1992

[86] PCT No.: PCT/AU92/00352

§ 371 Date: Jan. 11, 1994

§ 102(e) Date: Jan. 11, 1994

[87] PCT Pub. No.: WO93/01907

PCT Pub. Date: Feb. 4, 1993

[30] Foreign Application Priority Data

Jul. 16, 1991 [AU] Australia ..... PK7217

[51] Int. Cl.[6] ..... B21J 15/34

[52] U.S. Cl. ..... 29/243.526; 29/243.521

[58] Field of Search ..... 29/243.521, 243.526

[56] References Cited

U.S. PATENT DOCUMENTS

| | | | |
|---|---|---|---|
| 1,920,362 | 8/1933 | Dean | 29/243.521 |
| 2,216,767 | 10/1940 | Davitow | 29/243.521 |
| 3,003,657 | 10/1961 | Siebol et al. | 29/243.521 |
| 3,048,296 | 8/1962 | Heidenwolf | 29/243.521 |
| 3,376,727 | 4/1968 | Hinden | 29/243.621 |
| 3,596,496 | 8/1971 | La Pointe | 29/243.521 |
| 3,774,437 | 11/1973 | Young . | |
| 3,955,395 | 5/1976 | Vecchione | 29/243.521 |
| 4,027,556 | 6/1977 | Klein et al. | 29/243.521 |
| 4,208,901 | 6/1980 | Elflein | 29/243.521 |
| 4,368,631 | 1/1983 | Tanikawa . | |

FOREIGN PATENT DOCUMENTS

| | | | |
|---|---|---|---|
| 35594/68 | 10/1969 | Australia . | |
| 67647/74 | 10/1975 | Australia . | |
| 70701/74 | 1/1976 | Australia . | |
| 76188/74 | 6/1976 | Australia . | |
| 538902 | 8/1984 | Australia . | |
| 062869 | 10/1982 | European Pat. Off. . | |
| 65110 | 11/1982 | European Pat. Off. . | |
| 0116954 | 8/1984 | European Pat. Off. . | |
| 1007148 | 4/1957 | Germany . | |
| 1209850 | 1/1966 | Germany | 29/243.521 |
| 211968 | 8/1984 | Germany . | |
| 640643 | 12/1978 | U.S.S.R. . | |
| WO86/06662 | 11/1986 | WIPO . | |

OTHER PUBLICATIONS

European patent application number EP116954, partial copy including Claims and Drawings only; Inventor: Totsu, Katsuyuki 29 Aug. 1984.

*Primary Examiner*—David Jones

*Attorney, Agent, or Firm*—Hovey, Williams, Timmons & Collins

[57] ABSTRACT

A riveting apparatus for fixing a rivet having a sleeve and a mandrel insertable through the sleeve. The apparatus includes a drive shaft adapted to be driven by a rotatable drive means such as a cordless electric drill or the like. The apparatus includes drivable means such as a mandrel engaging wheel for engaging and pulling the mandrel and means for pressing the mandrel against the drivable means. The pressing means is associated with the drivable means such that the drivable means operates the pressing means in response to the mandrel being pulled by the drivable means.

8 Claims, 3 Drawing Sheets

RIVETING APPARATUS

BACKGROUND OF THE INVENTION

1. Field of the Invention

The present invention relates to riveting apparatus. In particular the invention relates to riveting apparatus suitable to be driven via rotatable drive means such as a power drill or the like.

Rivets adapted for use with the apparatus of the present invention comprise a rivet sleeve having a flange at one end and a mandrel insertable through the rivet sleeve. The mandrel has a head at one end diametrically larger than the bore of the sleeve. When the mandrel inserted through the sleeve is pulled and snapped off by the riveting apparatus, with the sleeve inserted through workpieces, the workpieces are joined together by the flange and the other end of the sleeve which is deformed radially outwardly by being pressed by the head.

2. Discussion of the Prior Art

Manually operated riveting tools are known, for example as described in Australian Patent Specification 538902 by Taiyo Seiko Co. Ltd. However, a disadvantage of manually operated tools is that they require considerable physical effort to operate particularly when used repetitively or when tackling big riveting jobs such as roofing, fencing etc. or when using large gauge rivets which require more effort to fix.

OBJECTS AND SUMMARY OF THE INVENTION

An object of the present invention is to alleviate the disadvantages of the prior art. A further object of the present invention is to provide riveting apparatus suitable to be driven by rotatable drive means. For example, the riveting apparatus of the present invention may be adapted to be driven via a cordless electric drill or the like. However, it is to be appreciated that the apparatus of the present invention may be driven via any suitable rotatable drive means. In some embodiments the riveting apparatus may be integrated with the rotatable drive means such as an electric motor which can be mains or battery powered.

According to one aspect of the present invention there is provided riveting apparatus for fixing a rivet having a sleeve and a mandrel insertable through the sleeve, said apparatus being adapted to be driven via rotatable drive means and comprising;

a drive shaft;

means drivable by said shaft for engaging and pulling said mandrel;

means for pressing said mandrel against said drivable means;

said pressing means being associated with said drivable means such that said drivable means operates said pressing means in response to said mandrel being pulled.

The drivable means may comprise a mandrel wheel adapted to be driven by the drive shaft. In one form the mandrel wheel may be driven via a worm gear or the like formed on or attached to the drive shaft. The mandrel wheel may include a concave rim or peripheral surface and friction promoting means on its rim surface such as teeth, notches or serrations cut into it for gripping the rivet mandrel. The pressing means may comprise one or more pinch wheels. The or each pinch wheel may include a concave rim and/or friction promoting formations thereon. Alternatively the or each pinch wheel may have a relatively smooth rim surface.

The or each pinch wheel may be rotatably mounted on a lever element. The lever element may be pivotably supported on a pivot axis. Rotation of the lever element about the pivot axis may cause the or each pinch wheel to press the mandrel against the mandrel wheel. The apparatus may include means such as a cam means to rotate the lever element about the pivot axis when the drivable means pulls the rivet mandrel. The apparatus may include a nosepiece having an aperture for receiving the rivet mandrel and a rivet engaging surface for engaging the flange of the nosepiece. The nosepiece may be arranged such that it may move between an extended position and a retracted position. The cam means may be formed on or associated with the rivet nosepiece. The cam means may include a taper formed on the inner end of the nosepiece. As the nosepiece moves between its retracted and extended positions the taper may act upon the lever to cause it to rotate about its pivot axis.

According to a further aspect of the present invention there is provided riveting apparatus for fixing a rivet having a sleeve and a mandrel insertable through the sleeve, said apparatus being adapted to be driven via rotatable drive means and comprising:

a rotatable drive shaft;

reciprocating means for pulling the mandrel;

means for coupling said reciprocating means to said drive shaft such that when said drive shaft is rotated, said reciprocating means moves in a first direction for pulling said mandrel; and means for uncoupling said reciprocating means from said drive shaft upon completion of a riveting stroke.

The coupling means may include a helical groove formed on the drive shaft. The reciprocating means may include a sleeve element slidably fitted over the drive shaft. The coupling means may further include at least one projecting element associated with the sleeve element which engages the helical grove such that when the drive shaft is rotated the sleeve element translates linearly along its axis.

The uncoupling means may include means for disengaging the or each projecting element from the helical groove when the sleeve element has translated a distance which is at least as great as the minimum distance or stroke required to complete a riveting operation. This minimum distance is referred to herein as the "riveting stroke".

The or each projecting element may comprise a ball bearing. The coupling means may include one or more apertures in the sleeve element and means for maintaining the or each ball bearing in contact with the or each aperture and with the helical groove.

The uncoupling means may include one or more recesses associated with the maintaining means and operable to move the or each ball bearing out of contact with the helical groove when the sleeve element has translated a distance equal to the riveting stroke.

BRIEF DESCRIPTION OF THE DRAWING FIGURES

Preferred embodiments of the present invention will now be described with reference to the accompanying drawings wherein.

DETAILED DESCRIPTION OF A PREFERRED EMBODIMENT

Figure 1A:
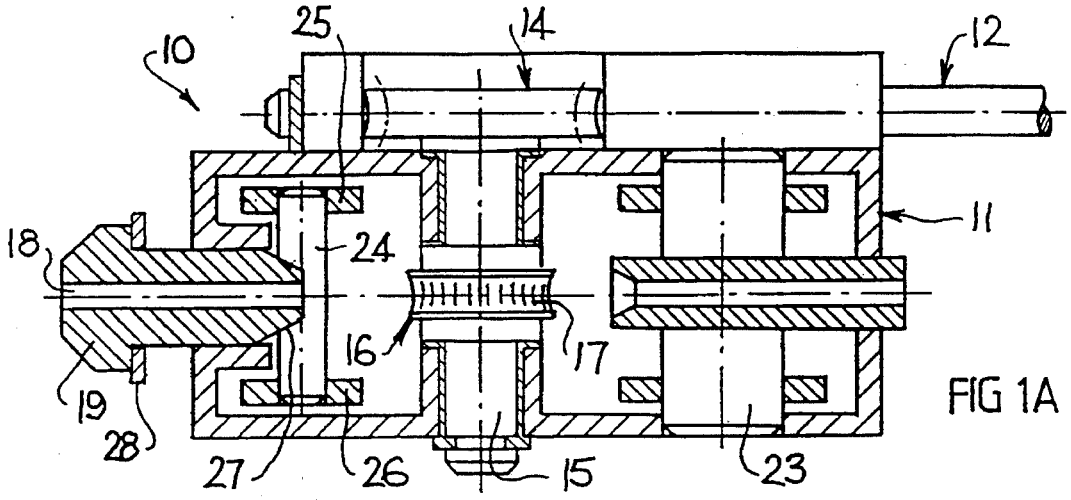
FIGS. 1A and 1B show sectional views of one form of riveting apparatus according to the present invention.
Figure 1B:
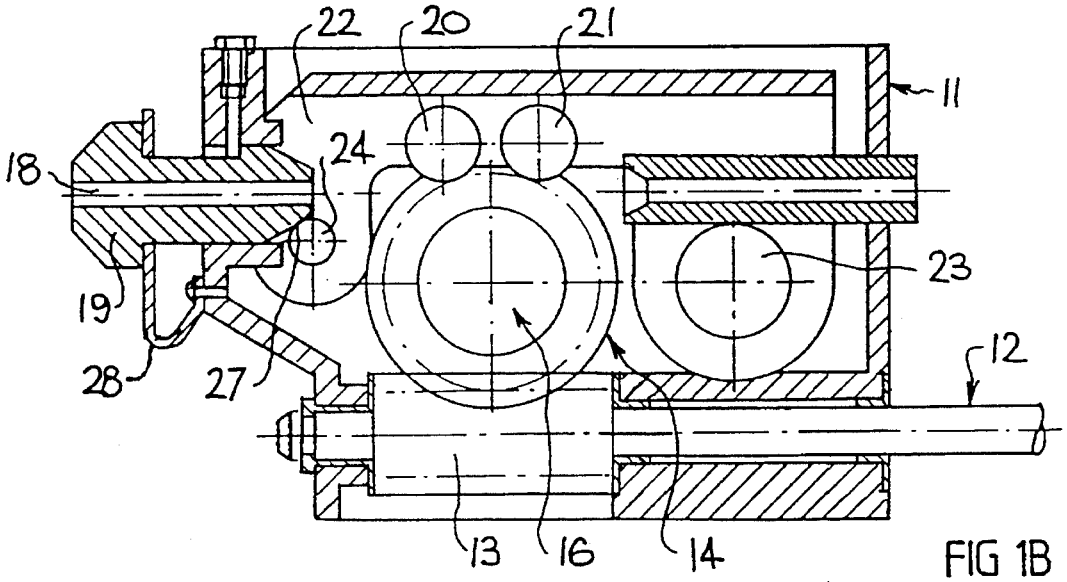

Referring to FIGS. 1A and 1B, the riveting apparatus shown generally at 10 comprises a housing 11 having a drivable shaft 12 rotatably journalled therein. Shaft 12 includes a worm gear 13 formed thereon which drivably engages gear wheel 14 of shaft 15 and is adapted to transfer drive to shaft 15 and to mandrel engaging wheel 16 which is secured to shaft 15. Wheel 16 has a concave rim or peripheral surface 17. Concave surface 17 has a plurality of friction promoting formations such as teeth, notches or serrations cut into it for gripping the mandrel portion of a rivet which extends into housing 11 via aperture 18 in rivet engaging nosepiece 19. Mandrel engaging wheel 16 co-operates with a pair of pinch wheels 20, 21 to grip the mandrel portion of a rivet therebetween. Each wheel 20, 21 may include a concave rim and/or friction promoting formations thereon. Wheels 20, 21 are rotatably mounted on a U-shaped lever element 22. Lever element 22 is pivotably supported at one end thereof on shaft 23 mounted in housing 11.

The other end of lever 22 includes cam engaging means in the form of a pin 24 stradding arms 25, 26 of U-shaped element 22. Cam engaging pin 24 contacts camming surface 27 on nosepiece 19. Camming surface 27 comprises a taper formed on the inner end of nosepiece 19.

In use the mandrel of a rivet is inserted into aperture 18 of nosepiece 19 such that the flange of the rivet abuts the leading face of the nosepiece and the mandrel of the rivet extends between the rim of wheel 16 and the rims of pinch wheels 20, 21. It may be seen that when mandrel engaging wheel 16 is driven (clockwise in FIG. 1B) via shaft 12, the mandrel engaged by wheel 16 is pulled inwards (to the right in FIGS. 1A/1B) causing the flange of the rivet to apply pressure to nosepiece 19. This causes nosepiece 19 to retract and camming surface 25 to apply downward pressure to cam engaging pin 23 and via lever element 22 to pinch wheels 20, 21. Wheels 20, 21 in turn press the mandrel of the rivet against mandrel engaging wheel 16.

This arrangement produces a pulling force on the mandrel which is fed back to pinch wheels 20, 21 because as the mandrel of the rivet is gripped between mandrel engaging wheel 16 and pinch wheels 20, 21 the mandrel is pulled inwards with greater force which in turn causes the mandrel to be gripped more tightly. The gripping/pulling forces on the mandrel of the rivet eventually build up until the mandrel is snapped off, completing the riveting operation. A return spring 28 is provided between the underside of nosepiece 19 and housing 11 to return nosepiece 19 to the extended position shown in FIGS. 1A/1B.

Figure 2B:
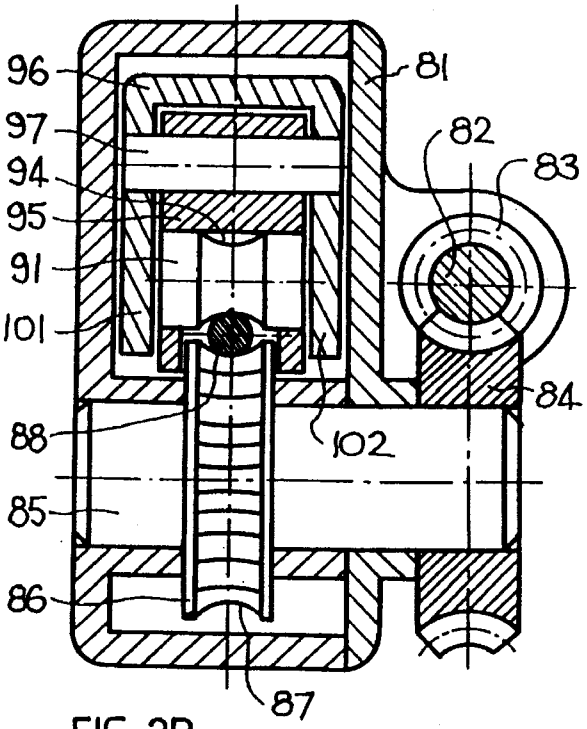
FIGS. 2A and 2B show sectional views of another form of riveting apparatus according to the present invention.
Figure 2A:
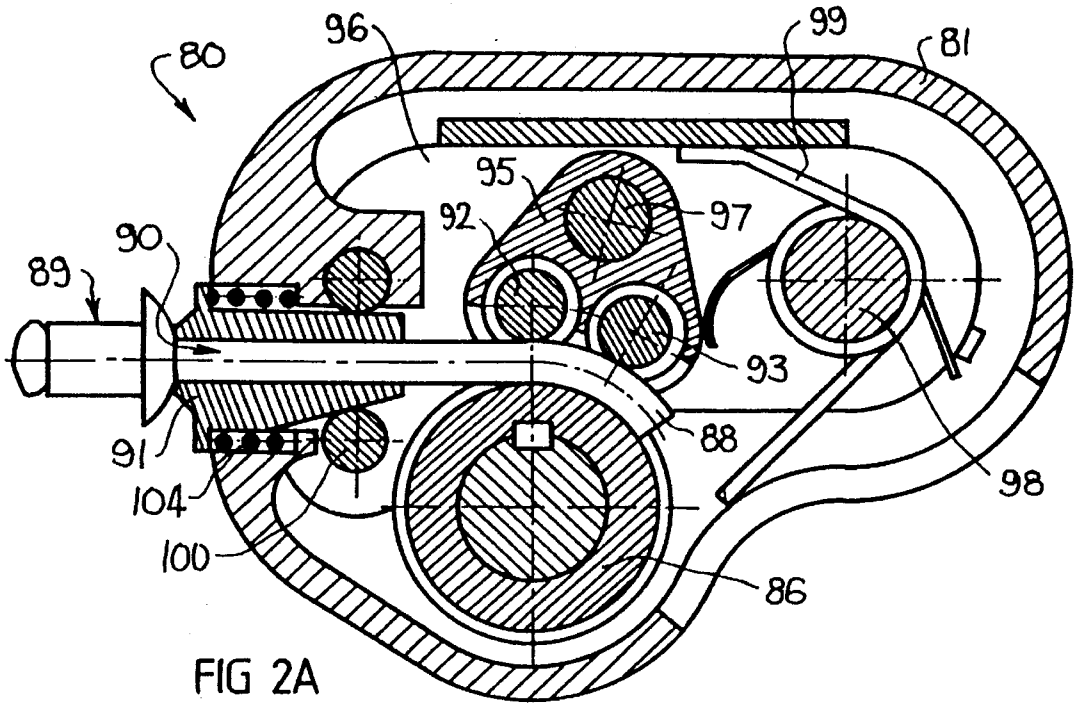

Referring to FIGS. 2A and 2B, the riveting apparatus shown generally at 80 comprises a housing 81 having a drivable shaft 82 rotatably journalled therein. Shaft 82 includes a worm gear 83 formed thereon which drivable engages gear wheel 84 of shaft 85 and is adapted to transfer drive to shaft 85 and to mandrel engaging wheel 86 which is secured to shaft 85. Wheel 86 has a concave rim or peripheral surface 87. Concave surface 87 has a plurality of friction promoting formations such as teeth, notches or serrations cut into it for gripping the mandrel portion 88 of a rivet 89 which extends into housing 81 via aperture 90 in rivet engaging nosepiece 91. Mandrel engaging wheel 86 co-operates with a pair of pinch wheels 92, 93 to grip mandrel portion 88 of rivet 89 therebetween. Each wheel 92, 93 includes a concave rim 94 having a friction promoting formation thereon. Wheels 92, 93 are rotatably mounted on carrier 95. Carrier 95 is pivotably mounted on a U-shaped lever element 96 via pivot pin 97. Lever element 96 is pivotably supported at one end thereof on shaft 98 mounted in housing 81. A torsion spring 99 biases lever element 96 in a clockwise direction.

The other end of lever 96 includes cam engaging means in the form of a pin 100 stradding arms 101, 102 of U-shaped element 96. Cam engaging pin 100 contacts camming surface 103 on nosepiece 91. Camming surface 103 comprises a taper formed on the inner end of nosepiece 91.

In use the mandrel of a rivet is inserted into aperture 90 of nosepiece 91 such that the flange of the rivet 89 abuts the leading face of nosepiece 91 and the mandrel 88 of rivet 89 extends between the rim of wheel 86 and the rims of pinch wheels 92, 93. It may be seen that when mandrel engaging wheel 86 is driven (clockwise in FIG. 2A) via shaft 82, mandrel 88 engaged by wheel 86 is pulled inwards (to the right in FIG. 2A) causing the flange of rivet 89 to apply pressure to nosepiece 91. This causes nosepiece 91 to retract and camming surface 103 to apply downward pressure to cam engaging pin 100 and via lever element 96 and carrier 95 to pinch wheels 92, 93. Carrier 95 allows the axes of pinch wheels 92, 93 to pivot relative to mandrel engaging wheel 86 permitting a more even distribution of force between pinch wheels 92, 93. Wheels 92, 93 in turn press mandrel 88 of rivet 89 against mandrel engaging wheel 86.

This arrangement also produces a pulling force on mandrel 89 which is fed back to pinch wheels 92, 93 because as mandrel 88 of rivet 89 is gripped between mandrel engaging wheel 86 and pinch wheels 92, 93 the mandrel 88 is pulled inwards with greater force which in turn causes mandrel 88 to be gripped more tightly. The gripping/pulling forces on the madrel 88 of rivet 89 eventually build up until mandrel 88 is snapped off, completing the riveting operation. A return spring 104 is provided between the underside of nosepiece 91 and housing 81 to return nosepiece 91 to an extended position.

Figure 3A:
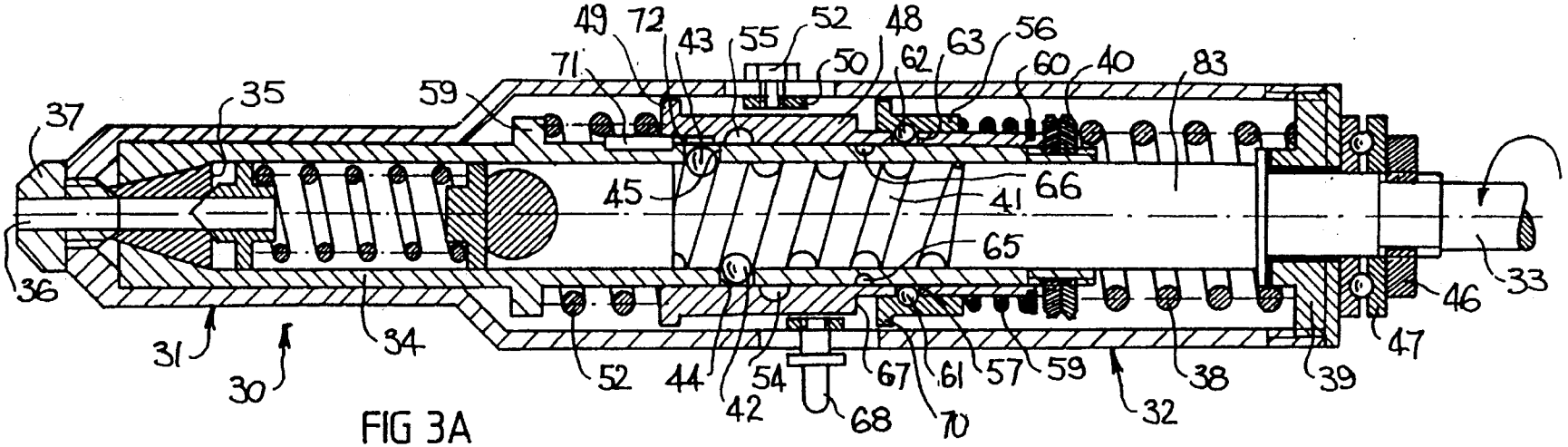
FIGS. 3A and 3B show sectional views of a further form of riveting apparatus according to the present invention.
Figure 3B:
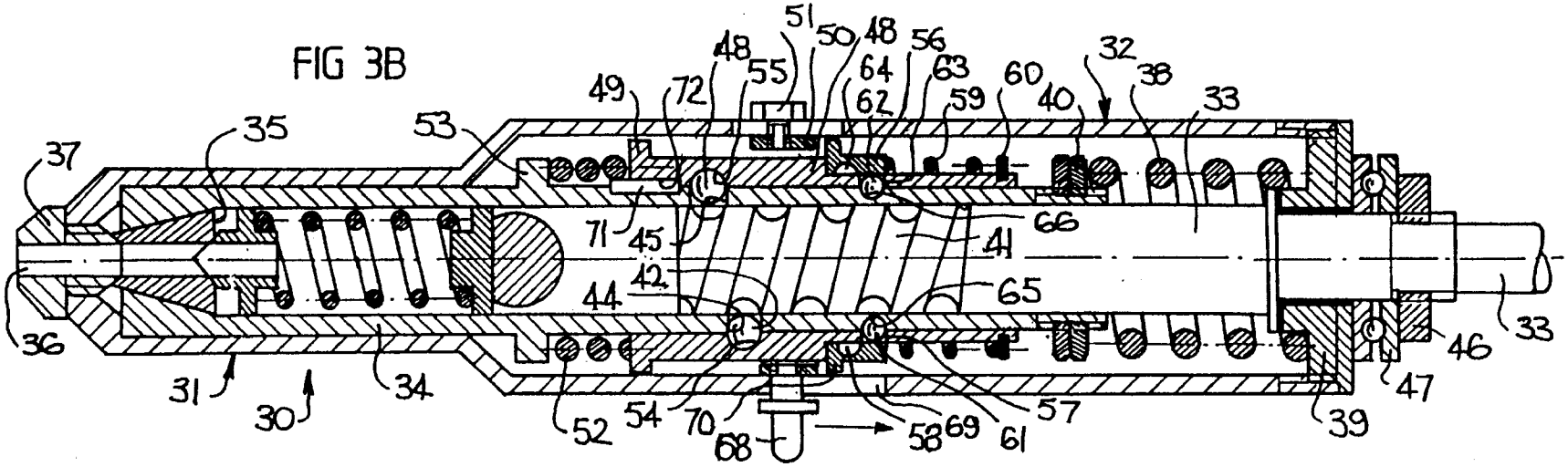

Referring to FIGS. 3A and 3B the riveting apparatus shown generally at 30 comprises a main housing which is essentially tubular (eg. cylindrical) and includes a stepped forward portion 31 and a rear portion 32. Forward portion 31 houses a rivet mandrel gripping and pulling mechanism not unlike that described in aforementioned Patent Specification AU-538902, the contents of which are incorporated herein by cross reference. The rear portion 32 houses a novel mechanism in accordance with the present invention. The latter mechanism is essentially adapted to convert rotating movement of a drivable shaft 33 to reciprocating linear movement of sleeve element 34 within the main housing. It is to be appreciated that during a riveting operation sleeve element 34 is moved inwards (to the right in FIGS. 3A/3B) to cause chuck element 35 associated with sleeve element 34 to grip and pull the mandrel portion of a rivet, which extends into housing portion 31 via aperture 36 in rivet nosepiece 37, and is returned to the position shown in FIGS. 3A/3B upon completion of the riveting operation.

The abovementioned mechanism will now be described with reference to FIGS. 3A–3B. Sleeve element 34 is fitted over drivable shaft 33 so that it can slide to-and-fro therealong. A return spring element 38 is interposed between endpiece 39 and adjustable stop element 40 on sleeve 33. Stop element 40 comprises a pair of nuts threadedly engaging sleeve 34. Spring 38 biases sleeve 34 towards the start position shown in FIG. 3A, ie. to the left in FIGS. 3A/3B. Shaft 33 includes a helical groove 41 cut into its outer periphery as shown. Groove 41 receives at least one ball bearing 42 therein such that substantially half of ball bearing 42 extends beyond the periphery of shaft 33. FIGS. 3A/3B show a second ball bearing 43 received in groove 41 but this is optional and may be desirable in heavy duty applications. Ball bearing 42 engages aperture 44 formed in sleeve 34. Ball bearing 43 engages corresponding aperture 45 formed in sleeve 33.

As shaft 33 is rotated in the direction shown by the arrow in FIG. 3A (eg. via a cordless drill or the like) and sleeve 34 is prevented from rotation therewith by any suitable means (not shown), balls 42, 43 move to the right along helical groove 41 in shaft 33. Because balls 42, 43 are captured in respective apertures 44, 45 formed in sleeve 34, sleeve 34 moves to the right with balls 42, 43 against return spring 38. Because a reaction force is simultaneously applied to shaft 33 in the opposite direction (ie. to the left in FIG. 3A), a nut 46 threadedly engaging shaft 33 supports shaft 33 against endpiece 39 via thrust bearing 47.

Movement of sleeve element 34 to the right, (sleeve element 34 will hereinafter be referred to as first sleeve 34) causes movement of second sleeve 48 which is slidably fitted over first sleeve 34, with it. Second sleeve 48 moves to the right with first sleeve 34 until abutment 49 of second sleeve 48 contacts stop 50. Stop 50 may be adjustable via nut 51 and prevents further movement of second sleeve 48. Second sleeve 48 then stops whilst movement of first sleeve 34 continues causing spring 52, which is contained between abutment 49 of second sleeve 48 and abutment 53 of first sleeve 34, to compress.

Movement of first sleeve 34 (to the right) relative to second sleeve 48 eventually causes aperture 44 in first sleeve 34 to come into registration with recess 54 in second sleeve 48. This causes ball bearing 42 to leave helical groove 41 in shaft 33 and to lodge itself in recess 54. Aperture 45 in first sleeve 34 simultaneously comes into registration with recess 55 in second sleeve 48 causing ball bearing 43 to leave helical groove 41 in shaft 33 and to lodge itself in recess 55.

Movement of ball bearings 42, 43 from helical groove 41 in shaft 33 to respective recessess 54, 55 in second sleeve 34 has two consequences. Firstly, it releases first sleeve 34 from shaft 33 causing return spring 38 to move first sleeve 34 back to its left most position shown in FIG. 3B. Secondly, it acts to couple second sleeve 48 to first sleeve 34 as shown in FIG. 3B. Note that spring 52 is now in its compressed position.

It is to be appreciated that the distance between aperture 44 and recess 54 or between aperture 45 and recess 55 in the start position shown in FIG. 3A should be at least equal to the riveting stroke.

To ensure that sleeves 34, 48 remain coupled against the force of spring 52 as sleeve 34 returns to the start position shown in FIG. 2B, a mechanism for positively locking sleeves 34, 48 together is provided (ie. after second sleeve 48 has moved along first sleeve 34 by a distance equal to the riveting stroke).

The locking mechanism includes a third sleeve element 56 slidably fitted over second sleeve 48. The locking mechanism also includes aperture 57 in second sleeve 48 and recess 58 in third sleeve 56. Return spring 59 interposed between third sleeve 56 and a circlip 60 fitted in a groove in second sleeve 48 biases third sleeve 48 to the left. In the start position third sleeve 56 is held in the right most position relative to second sleeve 48 shown in FIG. 3A against the force of return spring 59 (spring 59 is in its compressed position) via ball bearing 61.

In the embodiment shown in FIGS. 3A/3B a second ball bearing 62 is shown in corresponding aperture 63 in second sleeve 48 and recess 64 in third sleeve 56, but this is optional.

Operation of the locking mechanism is as follows. When first sleeve 34 moves back with respect to second sleeve 48 during a riveting stroke, recesses 65, 66 provided in the outer periphery of the first sleeve 34, (which recesses 65, 66 are initially, ie. in the start position shown in FIG. 3A spaced from corresponding apertures 57, 63 by a distance equal to the distance between aperture 44 and recess 54 or between aperture 45 and recess 55 in the start position shown in FIG. 3A) capture ball bearings 61, 62 after sleeve 34 has moved back a distance equal to the riveting stroke as shown in FIG. 3B.

Movement of ball bearings 61, 62 into recesses 65, 66 releases third sleeve 56 whereupon spring 59 moves sleeve 56 to the left until it abuts step 67 in second sleeve 48. In the abutted position (shown in FIG. 3B) third sleeve 56 closes apertures 57, 63 in second sleeve 48 blocking ball bearing 61, 62 in recesses 65, 66 in first sleeve 34 so that they cannot escape thereby positively locking together first and second sleeves 34, 48.

After completing a riveting operation the riveting apparatus is in the position shown in FIG. 3B. To return the apparatus to the start position shown in FIG. 3A a mechanism for releasing second sleeve 48 from first sleeve 34 is provided.

The release mechanism comprises release element 68 slidably mounted in slot 69 formed in the main housing of the apparatus. When it is desired to return second sleeve 48 to the start position shown in FIG. 3B, release element is manually pushed to the right as shown by the arrow in FIG. 3B until it contacts abutment 70 on third sleeve 56. Continued movement of release element 68 to the right causes sliding movement of third sleeve 56 along second sleeve 48 to the right against the force of spring 59. Spring 59 compresses until recesses 58, 64 in third sleeve 56 register with apertures 57, 63 in second sleeve 48, at which time ball bearings 61, 62 are released from recesses 65, 66 in first sleeve 34. This unlocks second sleeve 48 from first sleeve 34 allowing second sleeve 48 to move to the right under the influence of spring 52 ie. back to the position shown in FIG. 3A. Ball bearings 61, 62 are returned to respective recesses 58, 64 in third sleeve 56 preventing further movement of third sleeve 56 and retaining spring 59 in the compressed position shown in FIG. 3A. After returning the apparatus to the start position shown in FIG. 3A the riveting operation may be repeated by rotating shaft 33.

To prevent rotation between sleeves 34, 48 a projecting key 71 is provided on sleeve 34 and a corresponding keyway 72 is provided in sleeve 48.

Finally, it is to be understood that various alterations, modifications and/or additions may be introduced into the constructions and arrangements of parts previously described without departing from the spirit or ambit of the invention.

I claim:

1. Riveting apparatus for fixing a rivet having a sleeve and a mandrel insertable through the sleeve, said apparatus comprising:

a drive shaft adapted to be driven via rotatable means;

a mandrel wheel drivable by said drive shaft for engaging and pulling said mandrel;

means for pressing said mandrel against said mandrel wheel;

said pressing means being associated with said mandrel wheel such that said mandrel wheel operates said pressing means in response to said mandrel being pulled.

2. Riveting apparatus according to claim 1 wherein said mandrel wheel includes a concave rim having a friction promoting surface thereon.

3. Riveting apparatus according to claim 1, wherein said pressing means is mounted on a lever element.

4. Riveting apparatus according to claim 3 wherein said pressing means comprises a pair of pinch wheels rotatably coupled to said lever element.

5. Riveting apparatus according to claim 3 wherein said pressing means comprises a pair of pinch wheels rotatably coupled to a carrier, said carrier being pivotably mounted on said lever element.

6. Riveting apparatus according to claim 3, wherein said lever element is pivotably supported relative to said drivable means and includes cam engaging means.

7. Riveting apparatus according to claim 6 including a main housing and a rivet engaging nosepiece retractably mounted in said housing, said nosepiece including a camming surface.

8. Riveting apparatus according to claim 7 wherein said nosepiece is adapted to retract when said mandrel is pulled by said mandrel wheel causing said camming surface to engage said cam engaging means, said cam engaging means being effective to cause said lever element and said pressing means to pivot relative to said mandrel wheel such that said pressing means presses said mandrel against said mandrel wheel as said mandrel wheel is driven by said drive shaft.

* * * * *